US005102256A

United States Patent [19]

Gosnell

[11] Patent Number: 5,102,256

[45] Date of Patent: Apr. 7, 1992

[54] CONTAINMENT SYSTEM FOR PAVING MATERIAL

[76] Inventor: Glenn D. Gosnell, 28047 Dorothy Dr., Suite 302, Agoura Hills, Calif. 91301

[21] Appl. No.: 722,193

[22] Filed: Jun. 27, 1991

Related U.S. Application Data

[63] Continuation of Ser. No. 433,282, Nov. 8, 1989, abandoned, which is a continuation of Ser. No. 268,290, Nov. 7, 1988, abandoned.

[51] Int. Cl.[5] ..... E01C 11/12; A01G 1/00

[52] U.S. Cl. ..... 404/40; 404/7

[58] Field of Search ..... 404/7, 13, 34, 40, 41, 404/43; 52/102, 126.6, 236.9, 263

[56] References Cited

U.S. PATENT DOCUMENTS

| | | | |
|---|---|---|---|
| 696,792 | 4/1902 | Bedell | 404/7 |
| 722,580 | 3/1903 | Hill | 404/7 |
| 739,854 | 9/1903 | Gest | 404/7 X |
| 775,791 | 11/1904 | Austin | 404/7 X |
| 1,067,750 | 7/1913 | Brown | 404/7 |
| 1,166,664 | 1/1916 | Dargento | 404/7 |
| 2,065,861 | 12/1936 | Lines | 404/7 |
| 3,037,433 | 6/1962 | Maher | 404/7 |
| 3,096,695 | 7/1963 | Reinhardt | 404/43 |
| 3,174,412 | 3/1965 | Boyd et al. | 404/7 X |
| 3,326,099 | 6/1967 | Cova et al. | 404/7 |
| 3,636,829 | 1/1972 | Palmer | 404/7 |
| 3,712,187 | 1/1973 | Stelling | 404/7 X |
| 3,882,954 | 7/1974 | Ansearlusson | 404/7 |
| 3,918,222 | 11/1975 | Bahramian | 52/263 X |
| 4,349,596 | 9/1982 | Hendrix | 404/7 X |
| 4,445,802 | 5/1984 | Loov | 404/7 X |
| 4,577,448 | 3/1986 | Howorth | 404/40 X |
| 4,660,344 | 4/1987 | Gaudelli et al. | 404/7 X |

*Primary Examiner*—Thuy M. Bui

*Attorney, Agent, or Firm*—Irving Keschner

[57] ABSTRACT

A system for containing paving material, such as brick, wherein a plurality of interlocked prefabricated concrete sections are arranged in a predetermined pattern, the paving material being placed within the area formed by the containment system. The elongated sections, in one embodiment, have male elements formed at their ends and at least two sections are adapted to engage a selected one of a plurality of coupler devices having female elements thereon to form a portion of the desired containment system. The coupler devices each comprise at least one recess, or female element, to receive the male element formed on the section ends and a pedestal portion extending into the containment area, fill material overlying the surface of the pedestal portion to further enhance the ability of the interlocked concrete sections to resist separation. In a second embodiment, female elements are formed at the ends of the elongated sections and the selected coupler device has complementary male elements and a pedestal portion extending into the containment area.

7 Claims, 4 Drawing Sheets

FIG. 1
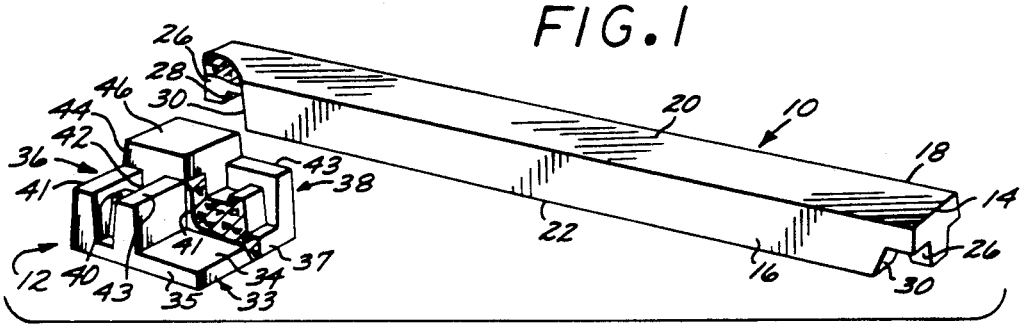
FIG. 2
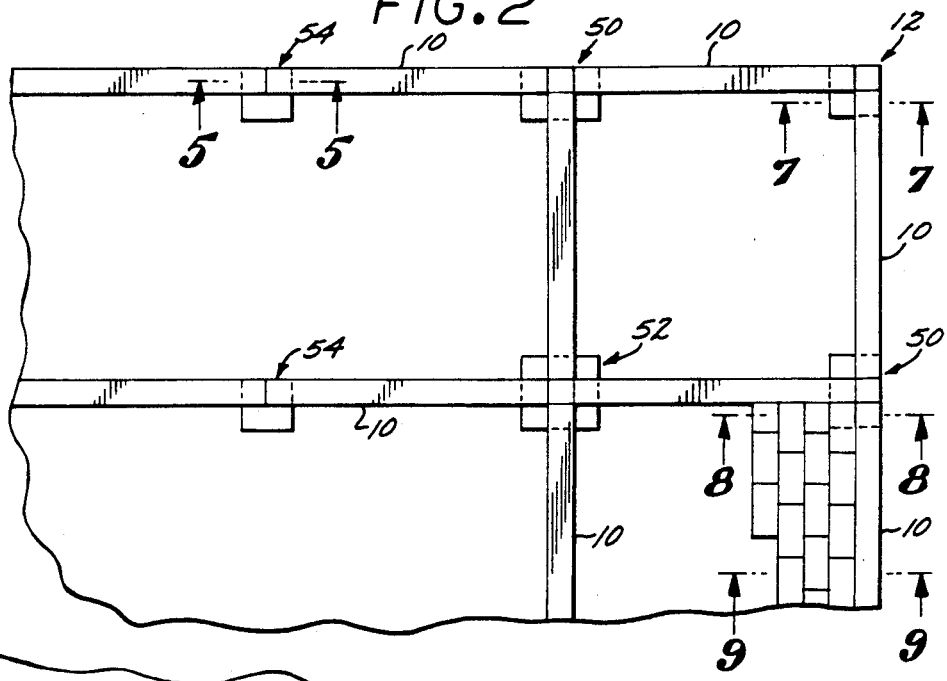
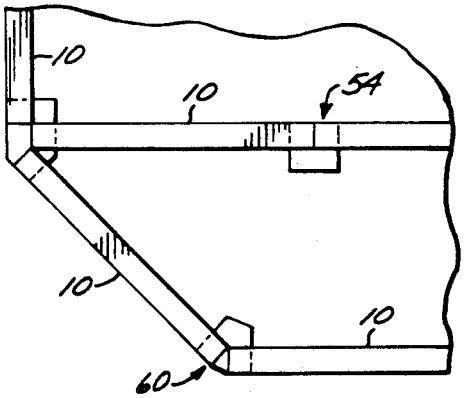
FIG. 3
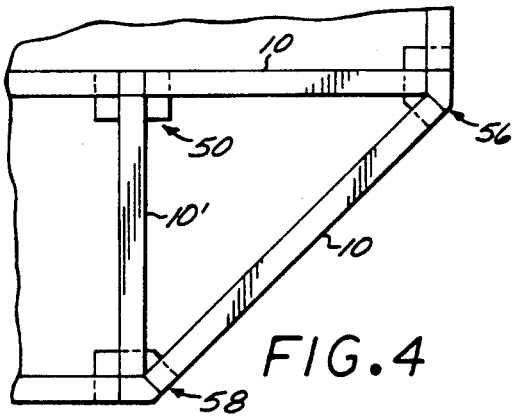
FIG. 4

FIG. 11
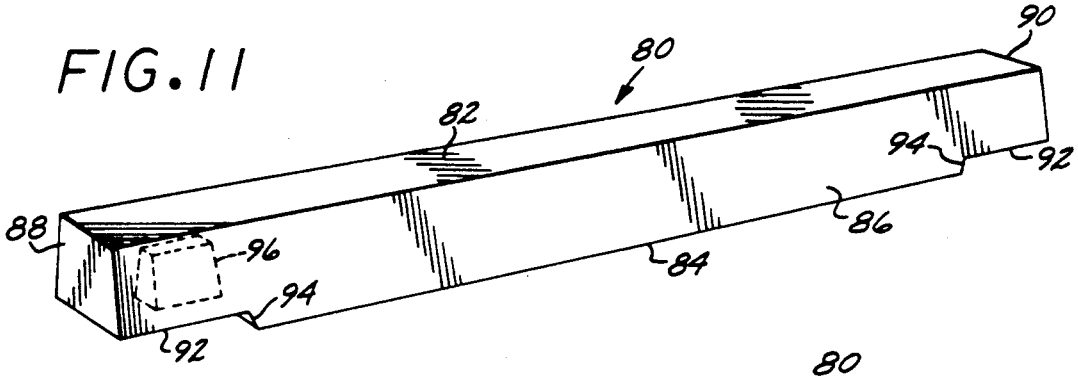
FIG. 12
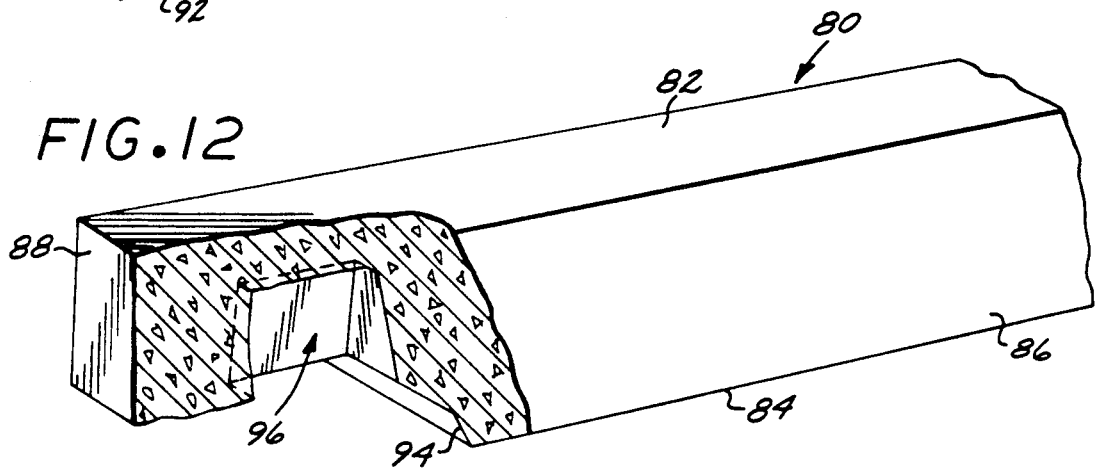
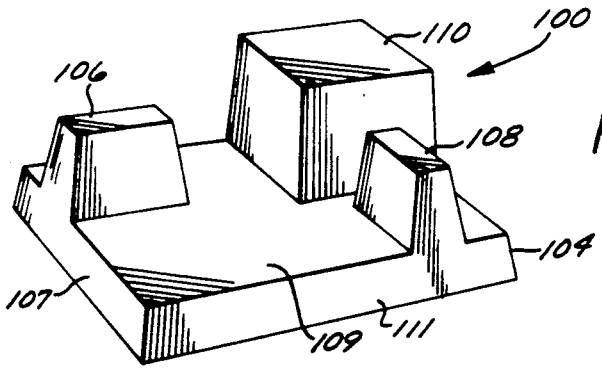
FIG. 13A
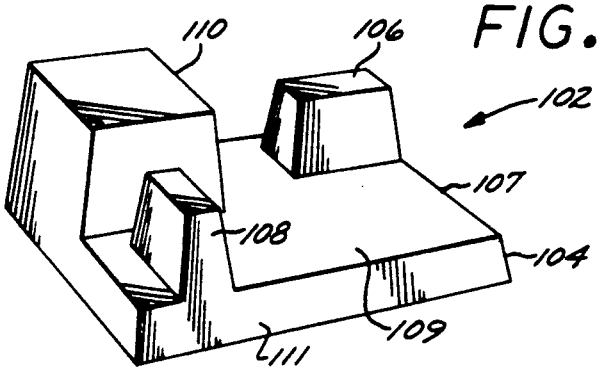
FIG. 13B

CONTAINMENT SYSTEM FOR PAVING MATERIAL

CROSS-REFERENCES TO RELATED APPLICATIONS

This application is a continuation of U.S. patent application Ser. No. 07/433,282 filed Nov. 08, 1989 now abandoned; which is a continuation of U.S. patent application Ser. No. 268,290 filed Nov. 7, 1988 now abandoned.

BACKGROUND OF THE INVENTION

1. Field of the Invention

The present invention relates to paver material containment systems and, in particular, to a containment system formed of a plurality of interlocked prefabricated concrete sections.

2. Description of the Prior Art

The typical manner of containment when setting mortarless pavers (interlocked pavers) or sandset brick has been to first pour a concrete curb. This is accomplished by first excavating the area, constructing the concrete forms, pouring the concrete and then removing the forms. Each step in the process typically takes one day, the process thus requiring a minimum of three days to construct the concrete curb. The costs per square foot of construction is thus relatively high on small installations. The installation also may require the use of a skilled tradesperson to form the curb, further increasing the cost of installation.

A number of interlocked curb systems have been disclosed in the prior art. Typical of prior art systems are set forth in U.S. Pat. No. 696,792 to Bedell which discloses a concrete curbstone molded in sections, each section having end projections and recesses, the projections of one end entering the recesses of the end of the adjacent curbstone; U.S. Pat. No. 2,065,861 to Lines which discloses a concrete curbing system having precast concrete sections, adjacent sections being coupled together by positioning a key member in recesses formed in the ends of adjacent sections, the sections having various forms, including semi-circular and straight forms; and U.S. Pat. No. 3,174,412 to Boyd et al. which discloses a combined curb and gutter system for roadways using precast concrete sections each having male and female interlocking joints at their ends, the design of the interlocking joints preventing separation of the curbing caused by various conditions and forces which tend to rupture and dislocate the masonry. Other patents disclosing interlocked or interconnected curb sections include U.S. Pat. No. 722,580 to Hill; U.S. Pat. No. 3,712,187 to Stelling; U.S. Pat. No. 3,822,954 to Ansgariusson; U.S. Pat. No. 775,791 to Austin; U.S. Pat. No. 3,037,433 to Maher; U.S. Pat. No. 3,636,829 to Palmer; U.S. Pat. No. 739,854 to Gest; U.S. Pat. No. 4,349,596 to Hendrix; U.S. Pat. No. 4,660,344 to Gaudelli et al.; U.S. Pat. No. 3,326,099 to Cova et al.; U.S. Pat. No. 1,067,501 to Brown; and U.S. Pat. No. 1,166,664 to Dargento.

Although the aforementioned patents disclose various techniques to prevent the interlocked sections from separating, the prior art systems do not provide completely satisfactory results, particularly since the ends of the interlocked sections require both male and female elements, increasing the fabrication cost of the section while decreasing the structural strength thereof. Further, the disclosed systems are not fully adaptable to the specific requirements of paver containment systems which require both underground and surface installation capabilities. What is thus desired is to provide a paver containment system comprised of precast, interlocking concrete sections wherein the interconnected sections are particularly resistant to longitudinal and rotational forces which would otherwise tend to separate the sections.

SUMMARY OF THE PRESENT INVENTION

The present invention provides a paver containment system comprising concrete curb sections, each section preferably fabricated off-site in a desired pattern. Each section is securely joined together using a novel coupler, or interlock, system. The coupler system uses a plurality of coupler members of varying configurations, the coupler member configuration selected for use depending upon the desired containment arrangement. Thus, a customer is provided, in effect, the opportunity of selecting from an unlimited number of containment arrangements. Each coupler member comprises, in a first embodiment, at least one recess for receiving a notch type member formed at one end of the concrete section and a pedestal type support member having a substantially flat surface area arranged to be positioned towards the area wherein the pavers are to be laid, paver fill material overlying the pedestal surface area to provide, with the notch/recess coupling, an improved system for preventing separation of the interlocked sections. In a second embodiment, each coupler member comprises at least one male member designed to engage a complementary recess formed adjacent one end of the concrete section and the aforementioned pedestal support member.

The containment system of the present invention requires no mortar, uses precured concrete curbs, or braces, and can be easily installed by a mason or homeowner, quickly and at a reduced cost.

BRIEF DESCRIPTION OF THE DRAWING

For a better understanding of the invention as well as other objects and further features thereof, reference is made to the following description which is to be read in conjunction with the accompanying drawing wherein:

FIG. 1 is a perspective view of the curb and coupler members;

FIGS. 2, 3 and 4 are partial plan views of a containment system using different coupler members;

FIG. 11 is a perspective view of a second curb embodiment;

FIG. 12 is a partial cross-sectional view of the curb embodiment shown in FIG. 11;

FIGS. 13(*a*) and (*b*) are perspective views of left and righthand couplers, respectively, used in conjunction with the curb embodiment shown in FIG. 11;

DESCRIPTION OF THE PREFERRED EMBODIMENT

Figure 5:
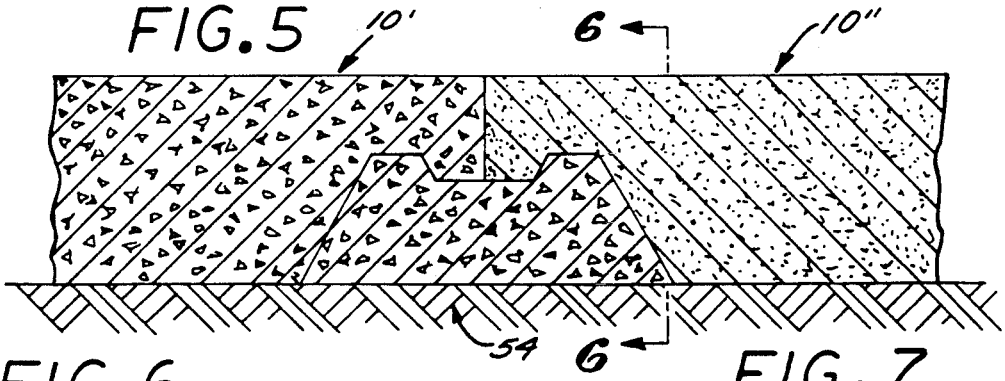
FIG. 5 is a cross-sectional view along line 5—5 of FIG. 2.

Referring to FIG. 1, a perspective view of a section 10 and a coupler, or interlock member, 12 constructed in accordance with the teachings of the present invention is illustrated. Section 10 comprises an elongated solid prefabricated concrete member 14 having a generally trapezoidal (beveled) cross-section with vertical extending faces 16 and 18 and generally planar upper and lower surfaces 20 and 22, respectively. The typical length of each section 10 is four feet (standard), the upper surface 20 having a width of approximately three inches, the lower surface 22 having a total width approximately one inch greater to provide the aforenoted bevel design. The beveled configuration provides a structure which in itself is inherently stable.

At the opposite ends of each section 10 are formed the male elements of the interlocking arrangement. In essence, the male element has a T-shape (end view). The vertical portion of the T-shape extends inwardly towards the center of section 10 and forms a knuckle, or projection, portion 26. The horizontal portion of the T-shape extends inwardly towards the center of section 10 to a distance greater than the inward distance of the vertical section of the T-shape as illustrated. The end of the horizontal portion of the T-shape is joined to lower, or bottom, surface 22 of section 10 by an angled wall portion 30, a recess 28 being formed by wall 30, the lower surface of the horizontal portion of the T-shape and the inner surface of the knuckle 26. Recess 28 is adapted to receive the knuckle, or projection, formed on coupler 12 as will be described hereinafter.

The coupler 12 illustrated in FIG. 1, known as a corner coupler, comprises a base member 33 having angled edges 35 and 37 (the thickness of base member 33 and the angle of edges 35 and 37 are selected so that the sections 10 are of the same height (coplanar) with interlocking coupler member 12), a substantially flat surface area (known as a pedestal) 34, orthogonal channel areas 36 and 38 each having a knuckle, or projection, 40 within channel walls 41 and 43 and knuckle, or projection, receiver recess 42. The channel areas 36 and 38 and the associated knuckles are mirror images of the knuckle and knuckle receiver formed on the ends of section 10. The vertical walls 41 and 43 both act to guide the section ends into engagement with the mirror knuckle and receiver on the coupler 12 and also act as an additional technique to resist tipping of the section 10 after the section engages the coupler. The vertical walls 41 and 43 are designed to be deep enough to enable the section 10 to resist tipping. Vertical extending member 44 is provided so that when two sections 10 are positioned in channels 41 and 43, the upper surface 20 of the engaged sections 10 are substantially coplanar with the upper surface 46 of projection, or vertical extension, 44 such that the two sections 10 and coupler 12 which form a portion of the containment system are at the same level.

An important feature of the coupler of the present invention is the provision of pedestal portion 34. Portion 34 provides an additional technique for preventing section separation otherwise caused by rotational forces. In particular, the pedestal 34 for each coupler configuration extends into the containment area so that sand or other fill material covers the upper surface of the pedestal. Thus, both the paver element positioned on the surface of the fill material and the fill material provide a load force on the surface of pedestal 34 which prevents joined sections 10 from rotating out from the interlocked connection with coupler 12. In essence, the pedestal acts as a cantilever to inhibit the tendency of the elongated sections to rotate out of alignment.

FIGS. 2, 3 and 4 are plan views of a paver installation to illustrate the different configurations of coupler members which can be utilized in the present invention. In particular, corner coupler 12 (shown in FIG. 1), tee coupler 50, universal coupler 52, straight coupler 54, right or left hand coupler 56, left hand or right hand coupler 58 and professional miter coupler 60 enable the containment system to be designed to accommodate a selected installation area. The coupler 60 allows pavers to be laid over a large area without the necessity of a grid system, coupler 58 in contrast having a third female element to enable a section 10' to be positioned as shown in FIG. 4, section 10' functioning as a grid to enable a homeowner to lay the paver accurately over smaller areas within the containment system.

Figure 6:
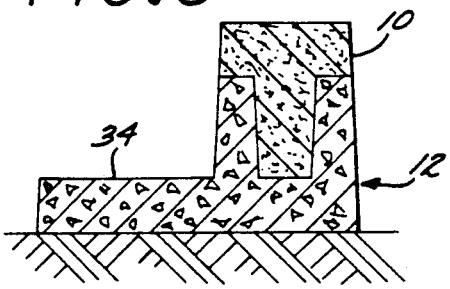
FIG. 6 is a cross-sectional view along line 6—6 of FIG. 5.
Figure 7:
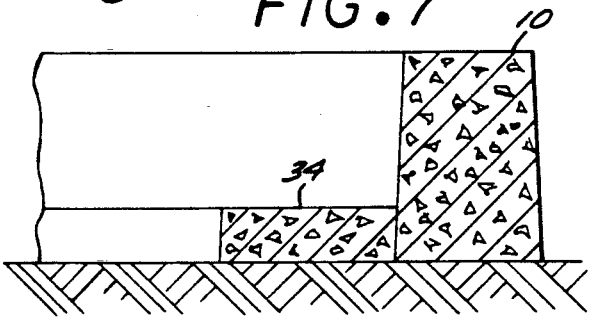
FIG. 7 is a cross-sectional view along line 7—7 of FIG. 2.
Figure 8:
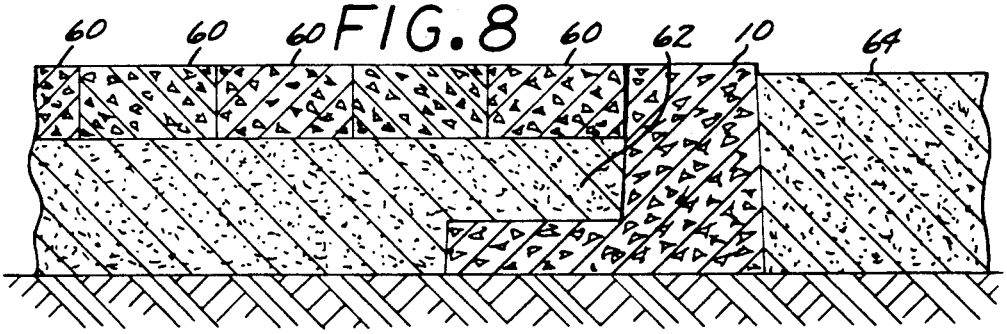
FIG. 8 is a cross-sectional view along line 8—8 of FIG. 2.
Figure 9:
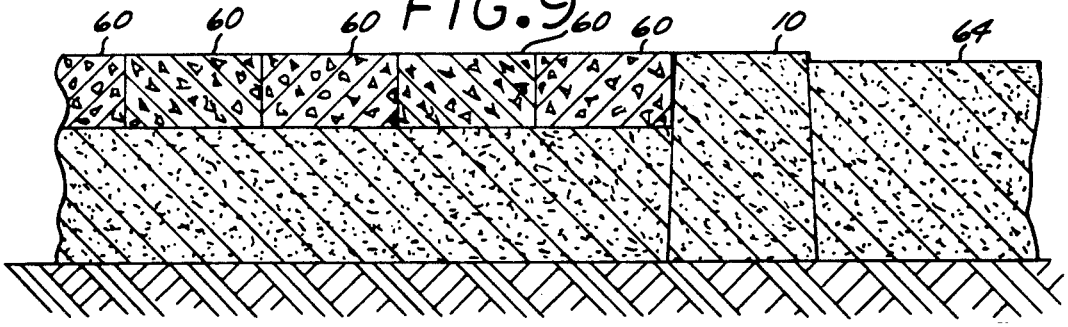
FIG. 9 is a cross-sectional view along line 9—9 of FIG. 2.
Figure 10:
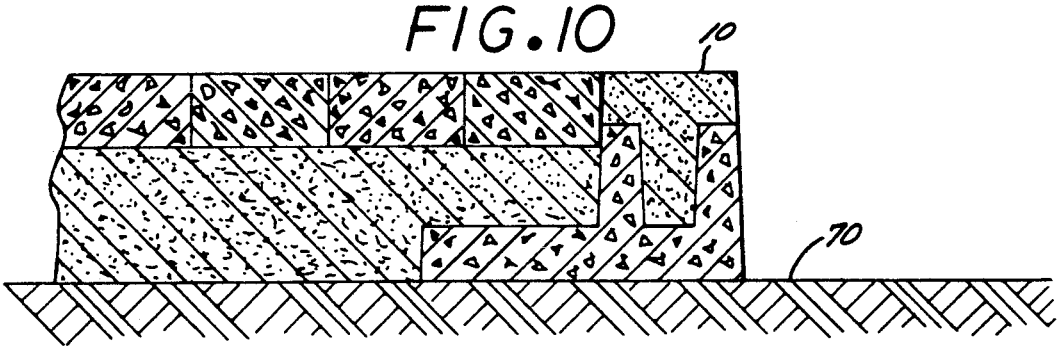
FIG. 10 is similar to FIG. 8 but shows the containment system formed on an existing foundation.

FIGS. 5 and 6 are cross-sectional views illustrating the use of a straight coupler 54 to couple two sections 10' and 10''. Each coupler arrangement shown in FIGS. 2-4 have common features. In particular, each coupler includes a knuckle/recess feature, as described with reference to FIG. 1, such that the corresponding knuckle formed on a selected section can be positioned in the coupler recess and the knuckle on the coupler can engage the recess formed in each end of section 10. In addition, each coupler includes at least one pedestal portion similar to the pedestal portion 34 shown in FIG. 1 to receive the fill material as previously described. FIG. 7 is a sectional view illustrating corner coupler 12; FIG. 8 is a sectional view of a tee coupler identical to coupler 50 and illustrates a plurality of pavers (bricks) 60 laid over the fill material, such as gravel 62, section 10 being supported by backfill 64; FIG. 9 is a sectional view illustrating another portion of the contained area; and FIG. 10 is a sectional view similar to FIG. 8, the containment system being supported on an existing foundation 70, backfill not being required.

FIG. 11 is a perspective view of a second embodiment of an elongated interlocking curb section 80 utilized in the containment system of the present invention. Curb section 80 comprises a top portion 82, bottom portion 84, side portion 86 (a second side is not shown in the figures) and ends 88 and 90. As shown in the figure, a portion of bottom portion 84 adjacent both ends 88 and 90 is cutaway in a manner such that bottom portion 84 is coupled to intermediate surface 92 via angled surface 94. The distance between surfaces 84 and 92 and the angle of surface 94 are selected to conform to the dimensions of the coupler member to provide the aligned and coplanar containment system arrangement as illustrated in FIG. 15. A recess, or notch 96, is formed in curb section 80 adjacent each end 88 and 90 (only the recess adjacent end 88 is illustrated). The shape and dimensions of recess 96 are selected so that projections on the coupler members shown in FIGS. 13 and 14 can fit and be retained within the recess.

FIG. 12 is a partial sectional-perspective view of curb section 80 illustrating the detail of recess 96.

FIGS. 13(*a*) and (*b*) show one of the coupler members utilized with curb section 80. In particular, FIG. 13(*a*) shows a left side corner coupler 100, FIG. 13(*b*) showing a right side corner coupler 102. Each coupler member comprises a substantially rectangularly shaped base member 104 having angled edges 107 and 111 and two sawtooth shaped projections 106 and 108 vertically extending from the upper surface of base member 104. The shape and dimensions of projections 106 and 108 are selected such that they fit into recesses 96 formed in curb sections 80. The thickness of base member 104 corresponds to the distance between surfaces 84 and 92 as shown in FIG. 11 and the edges 107 and 11 are coplanar with angled surface 94 of section 80. Coupler members 100 and 102 also include a vertically extending projection member 110 which is of a height corresponding to the height of edge portions 88 and 90 (FIG. 11) and a pedestal portion 109 having a predetermined surface area. As noted with the discussion with reference to the embodiments described in FIGS. 1-10, pedestal portion 109 provides a load bearing surface which prevents rotational separation of interlocked curb sections 80.

Figure 14:
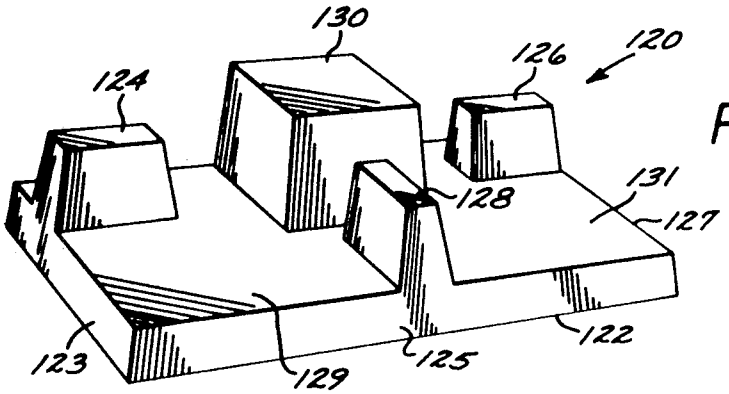
FIG. 14 is a perspective view of a Tee coupler used in conjunction with the curb embodiment shown in FIG. 11.
Figure 15:
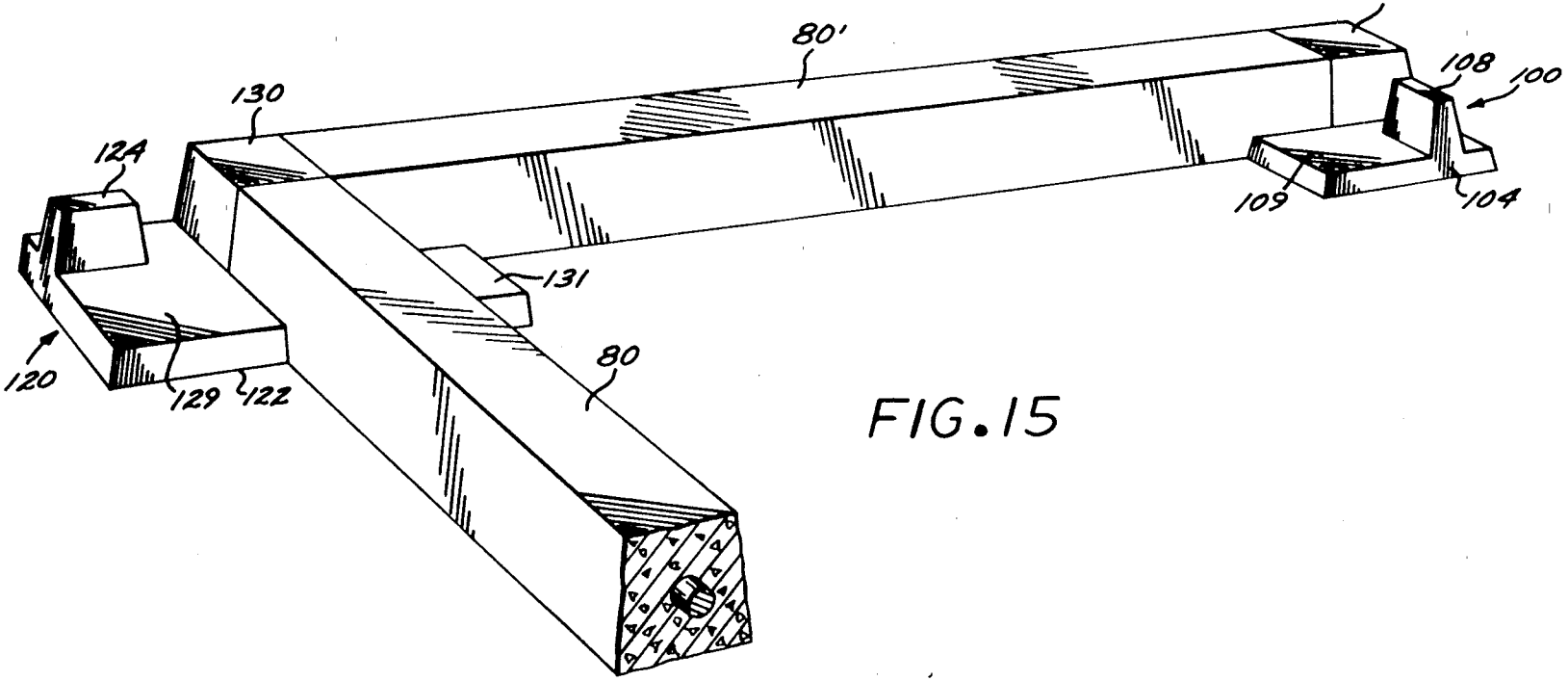
FIG. 15 is a perspective view illustrating a partially assembled containment system using the curb and coupler members shown in FIGS. 11-14.

FIG. 14 illustrates another coupler member 120 which can be utilized with curb section 80. Coupler member 120, known as a tee coupler, comprises base member 122 having angled edges 123, 125 and 127, sawtooth shaped projections 124, 126 and 128 vertically extending from the upper surface of base member 122 and vertically extending projection 130 which is of a height corresponding to the height of end portions 88 and 90 (FIG. 11). Pedestal portion 129 provides an anti-rotational separation force as explained hereinabove. As with the description of coupler members 100 and 102, projections 124, 126 and 128 have shapes and dimensions which allow them to be fit into recesses 96 formed in curb sections 80.

FIG. 15 is a perspective view of a portion of an assembled curb containment system showing two curb sections 80 and 80' joined at the left portion of the figure with a tee coupler 120, the right end of curb sections 80' being fitted onto a corner coupler member 100.

The present invention thus provides an improved paver containment system wherein at least two precast concrete containment sections are interlocked by a coupler to prevent section separation in the direction along the longitudinal axis of the section. The coupler also includes a pedestal portion which extends into the containment area. During an installation, gravel or other fill material is placed on the surface of the pedestal portion, the fill material and the pavers laid on the surface thereof preventing the interlocked sections from separating due to rotational forces.

While the invention has been described with reference to its preferred embodiment, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

What is claimed is:

1. A containment system for pavers comprising a plurality of separate elongated sections, each of said sections including top, bottom, sides and ends, a downwardly extending first projection being formed at each section end, and a first recess being formed at each end adjacent said first projection, said containment system further including a plurality of coupler members, each of said coupler members including a second recess and a second projection, said first projection formed on one end of said section fitting into the second recess formed in each of said coupler members, said second projection of each of said coupler members fitting into the first recess formed on said section end, each of said coupler members comprising a vertically extending member the height of which is such that the top surface thereof is substantially coplanar with the top surface of said sections when joined to each of said coupler members, each of said coupler members further comprising a shaped portion integral therewith extending towards said containment area and having a predetermined surface area, each of said coupler members being arranged such that when separate sections are coupled together by the coupler members and fill material is added to the containment area, fill material within the containment area overlies the extended shaped portions of said coupler members whereby the force applied to said extended shaped portions by said fill material prevents separation of the sections caused by system rotational forces.

2. A containment system for pavers comprising a plurality of separate elongated sections, each of said sections including top, bottom, sides and ends, a recess being formed adjacent each section end, said containment system further including a plurality of coupler members, each of said coupler members including at least one projection shaped to fit into said section recess, each of said coupler members further including a shaped portion integral therewith having a predetermined surface area, the containment system formed by separate sections coupled together by said coupler members being arranged such that when separate sections are coupled together by a coupler member, said shaped portion of each coupler member extending toward the containment area in which the pavers are positioned such that when fill material is added to the containment area it overlies the shaped portions of said coupler members whereby the force applied to said extended shaped portions by said fill material prevents separation of the sections caused by system rotational forces.

3. A member for coupling together two elongated sections in order to form a portion of a paver containment system, each of said elongated sections comprising top, bottom side and end portions and a recess formed in the bottom portion adjacent each end portion, said coupler member comprising a base member, at least one projection shaped to fit into said section recess extending vertically from the surface of said base member, a substantially planar shaped portion having a predetermined surface area and a vertically extending member the height of which is such that the top surface thereof is substantially coplanar with the top surface of said sections when joined together to each of said coupler members, at least three additional coupler members and at least two additional elongated sections being provided to form said paver containment system, the planar shaped portion of each coupler member extending towards the containment area formed by the containment system such that when fill material is added to the containment area it overlies the shaped portions of said coupler members whereof the force applied to said shaped portions by said fill material prevents separation of the sections caused by system rotational forces.

4. A containment system for pavers comprising a plurality of separate elongated sections, each of said sections including top, bottom, sides and ends, a downwardly extending first projection being formed at each section end, and a first recess being formed at each end adjacent said first projection, said containment system further including a plurality of coupler members, each of said coupler members including a first channel area having recess and projection portions and a second channel area having recess and projection portions, said first projection formed on one end of said section fitting into the first recess formed in said first channel area, the projection portion of said first channel area fitting into the first recess formed on said section end, a vertically extending member being positioned between the adjacent ends of said first and second channel areas, the height of said vertically extending member being such that the top surface thereof is coplanar with the top surface of said sections when joined to each of said coupler members, each of said coupler members further comprising a shaped portion having a predetermined surface area, said coupler members being arranged such that when separate sections are coupled together by a coupler member, said shaped portion of each coupler member extends toward the area in which the pavers are positioned.

5. A containment system for pavers comprising a plurality of separate elongated sections, each of said sections including a top, bottom, sides and ends, a downwardly extending first projection being formed at each section end, and a first recess being formed at each end adjacent said first projection, each end of said sections having a T-shape, the horizontal portion of the T-shape extending a first predetermined distance rearward towards the center of said section, the vertical portion of the T-shape extending a second predetermined distance rearward towards the center of said section, said second predetermined distance being less than said first predetermined distance, said containment system further including a plurality of coupler members, each of said coupler members including a second recess and a second projection, said first projection formed on one end of said section fitting into the second recess formed in said coupler member, said second projection of each of said coupler members fitting into the first recess formed on said section end, each of said coupler members further comprising a shaped portion having a predetermined surface area, said coupler members being arranged such that when separate sections are coupled together by a coupler member, said shaped portion of each coupler member extends toward the area in which the pavers are positioned.

6. The containment system of claim 5 wherein the end of said horizontal portion of said T-shape is joined to the bottom of said section by an angled wall portion.

7. The containment system of claim 6 wherein each of said coupler members includes an angled surface which is coaligned with the angled wall portion of said T-shape when said section is inserted into each of said coupler members.

* * * * *